US009568285B2

(12) United States Patent
Lewis

(10) Patent No.: US 9,568,285 B2
(45) Date of Patent: Feb. 14, 2017

(54) PORTABLE SMOKE SCREEN DELIVERY SYSTEM

(71) Applicant: Nathanial Henry Lewis, Fallon, NV (US)

(72) Inventor: Nathanial Henry Lewis, Fallon, NV (US)

( * ) Notice: Subject to any disclaimer, the term of this patent is extended or adjusted under 35 U.S.C. 154(b) by 125 days.

(21) Appl. No.: 13/998,794

(22) Filed: Dec. 9, 2013

(65) Prior Publication Data

US 2015/0159984 A1 Jun. 11, 2015

(51) Int. Cl.
*F41H 9/06* (2006.01)
*F41H 9/08* (2006.01)

(52) U.S. Cl.
CPC . *F41H 9/06* (2013.01); *F41H 9/08* (2013.01)

(58) Field of Classification Search
CPC ..... F42B 5/155; F42B 12/48; F42B 12/50; F41H 9/00; F41H 9/06; F41H 9/08
USPC ..... 102/334, 367; 89/1.11, 1.1
See application file for complete search history.

(56) References Cited

U.S. PATENT DOCUMENTS 4,303,397 A * 12/1981 Swiatosz ..... F41H 9/06 434/226
4,349,723 A * 9/1982 Swiatosz ..... F41H 9/06 122/40
5,168,544 A * 12/1992 Kolasa ..... F41H 9/06 392/387
5,562,455 A * 10/1996 Kirby ..... G09B 19/00 434/226
5,870,524 A * 2/1999 Swiatosz ..... F41H 9/06 392/394

* cited by examiner

*Primary Examiner* — James S Bergin

(57) ABSTRACT

This invention is about the art, science and technology of smoke screening. The three "areas of importance" are sea, land and air uses. During World War II military strategy was forever changed by the numerous offensive and defensive advantages created by the first ever effective large area smoke screen. Smoke screens were also used extensively during the Vietnam War. In wars since the Vietnam War there have been several military disasters—totally or partially—for not using smoke screens, it has been reported. This invention will eliminate leaking tanks, plugged up exhaust nozzles, loose control values, inaccurate gauges and regulators found in earlier and present smoke screen delivery systems. No new technology is required.

2 Claims, 5 Drawing Sheets

PORTABLE SMOKE SCREEN DELIVERY SYSTEM

BACKGROUND OF THE INVENTION

Field of the Invention

This invention is about the art, science and technology of smoke screening. Smoke screen three "areas of release" are AIR, LAND and SEA. The "three areas of importance" of smoke screening tactics are at SEA, perhaps LAND use and surely AIR being last. This is my personal opinion for today's U.S. Military need for smoke screening during conflicts.

Description of the Related Art

Smoke screen development was tried for over 2,000 years by the greatest armies: the Romans, Vikings, Germans, British, Americans and others. It was a World War II invention that made a smoke screen a meaningful component in military planning. One of the earliest recorded uses of smoke screen in combat was the burning of green vegetation by the Romans. In all early smoke screen attempts the method employed was direct flame contact with combustible materials; these combustion methods were mostly uncontrollable.

An important improvement during World War I was the smudge pot that allowed the burning of oil by contact with a heated metal plate; this avoided direct flame contact. It was more controllable and it produced a much thicker smoke. However, large amounts of oil were required to make the amount of smoke needed. During World War II the Alonzo Patterson system was developed, and military strategy was forever changed by the numerous offensive and defensive advantages created by the first ever effective large area smoke screen; there have never been any complaints from the troops about health problems when using the Patterson smoke screen system.

Smoke screens were used extensively during the Vietnam War. In wars since the Vietnam War there have been several military disasters—totally or partially—for not using smoke screens. There is no training in the use of smoke screening in any of today's U.S. Military Forces, at least to my knowledge. However, some of the Marines' assault amphibious vehicles (AAV7s), has an engine-generating smoke screen capability; they never use them for smoke screening.

This invention will eliminate leaking tanks, plugged up exhaust nozzles, loose control values, inaccurate pressure gauges and regulators found in earlier and present smoke screening systems. No high-pressure containers are required. No massive and bulky structures are needed. This invention is effective and relatively economical.

BRIEF SUMMARY OF THE INVENTION

The four "basic methods of smoke production" for screening: (a) burning phosphorus in air; (b) burning pyrotechnic compositions; (c) vaporization and re-condensation of oils; and (d) dispersion of reactive liquids. In warfare screening smokes have three major functions: blinding, covering and deception. Smoke screening compositions have remained basically unchanged since World War II. However, methods of delivery have been improved to keep up with the rapid rise in the technology of modern weapons; at least up to the end of the Vietnam War.

DETAILED DESCRIPTION

First, there is PHOSPHORUS SMOKES (WHITE), the mostly used and effective screening smokes formed by burning elemental phosphorous in air. Phosphorous smoke clouds are very efficient. Phosphorous smokes can be delivered from mortar rounds, rockets, grenades and artillery projectiles.

Second, the aerosols formed by burning PYROTECHNIC COMPOSITIONS generally are composed of hydrated chloride salts. These mixtures are also found in smoke pots and grenades.

Third, OIL SMOKES (BLACK) are used when large areas must be screened for long periods of time. In general they are much less expensive than other methods. Oil smokes are produced by spraying diesel oil on the exhaust manifold of a vehicle and allowing the exhaust gas pressure to push the cloud from the vehicle or by using fog oil, a specially produced smoke oil, with mechanical smoke generators.

During World War II, the U.S. and its Allies used simultaneous operation of many fog oil generators to screen several square miles of port areas, staging zones and terrain from air observation. Farmers have used oil smoke for many years to prevent their fruit trees and other crops from freezing.

Fourth, there are the REACTIVE LIQUID SMOKES. The most common reactive smokes are chlorosulfonic acid that produces sulfuric acid smoke. Reactive liquids are highly corrosive and dangerous; they are no longer used by the Military.

This system 10 comprises 5 major sections: (1) AIR UNIT; (2) MIXING CONTAINER; (3) HOLDING COMPARTMENT; (4) EXHAUST EQUIPMENT; and (5) CONTROL PANEL ASSEMBLY. The sections can be separated, cleaned and stored.

Figure 1:
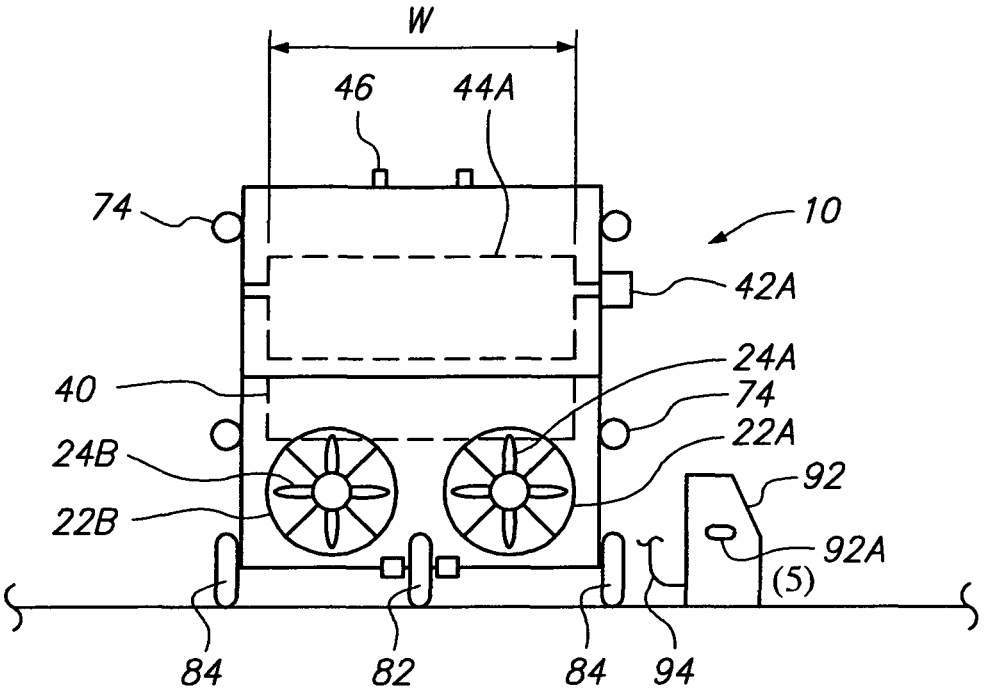
FIG. 1 is a front view of a portable smoke screen delivery system.

Refer to FIG. 1, a front view. The air unit (1) is comprised of a right air intake 22A and a left air intake 22B, a right large electric fan 24A and a left large electric fan 24B. The unit is mounted on one front removable steering wheel 82 and two rear fixed wheels 84. The holding compartment (3) is comprised of a front servo motor 42A and a front rectangular-shaped bucket 44A. The bucket 44A is used for pouring any smoke making compound or element. There are four lifting handles 46 for the four top doors and twelve total tie-down rings or lifting rings 74 for three major sections. The control panel assembly (5) is comprised of a portable control panel 92 and its lifting handles 92A, and a heavy-duty electric cable 94 that can be connected to a portable or fixed electric power supply.

Figure 2:
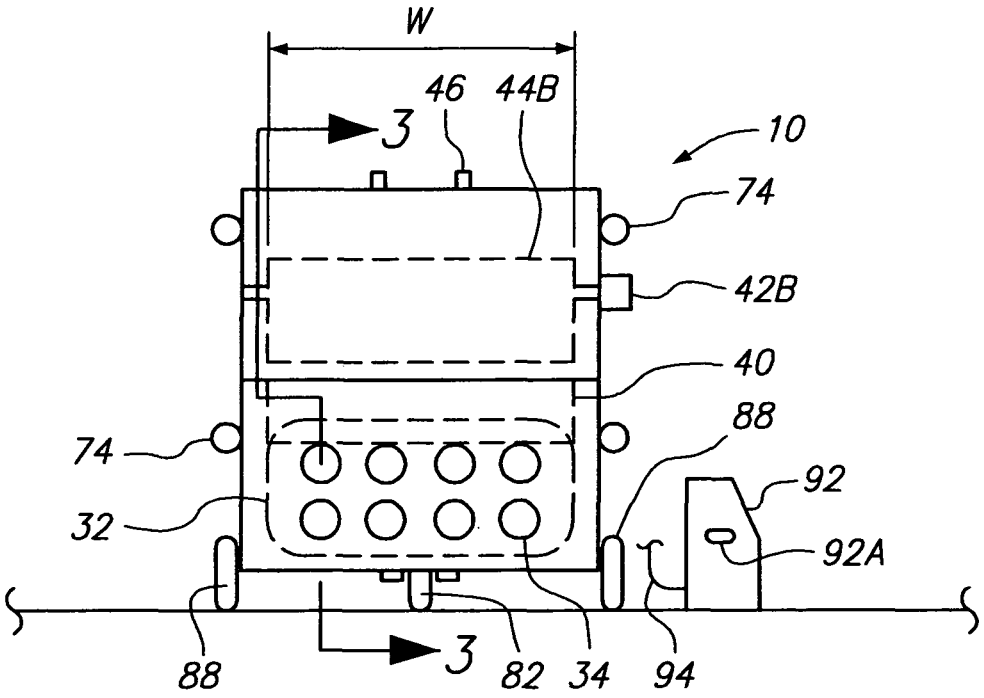
FIG. 2 is a rear view of the system.

Refer to FIG. 2, a rear view. The mixing container (2) is comprised of a mixing chamber 32 and a plurality of outlet holes 34. The chamber 32 is where the smoke making composition, heat and air meet; then the smoke is forced out. For rapid discharge of the screening smoke there are eight holes 34, four upper ones and four lower ones. The container is mounted on steerable rear wheels 88. The holding compartment (3) is comprised of a rear servo motor 42B, a rear rectangular shaped bucket 44B and a chute 40. The chute 40 has a rectangular opening.

Figure 3:
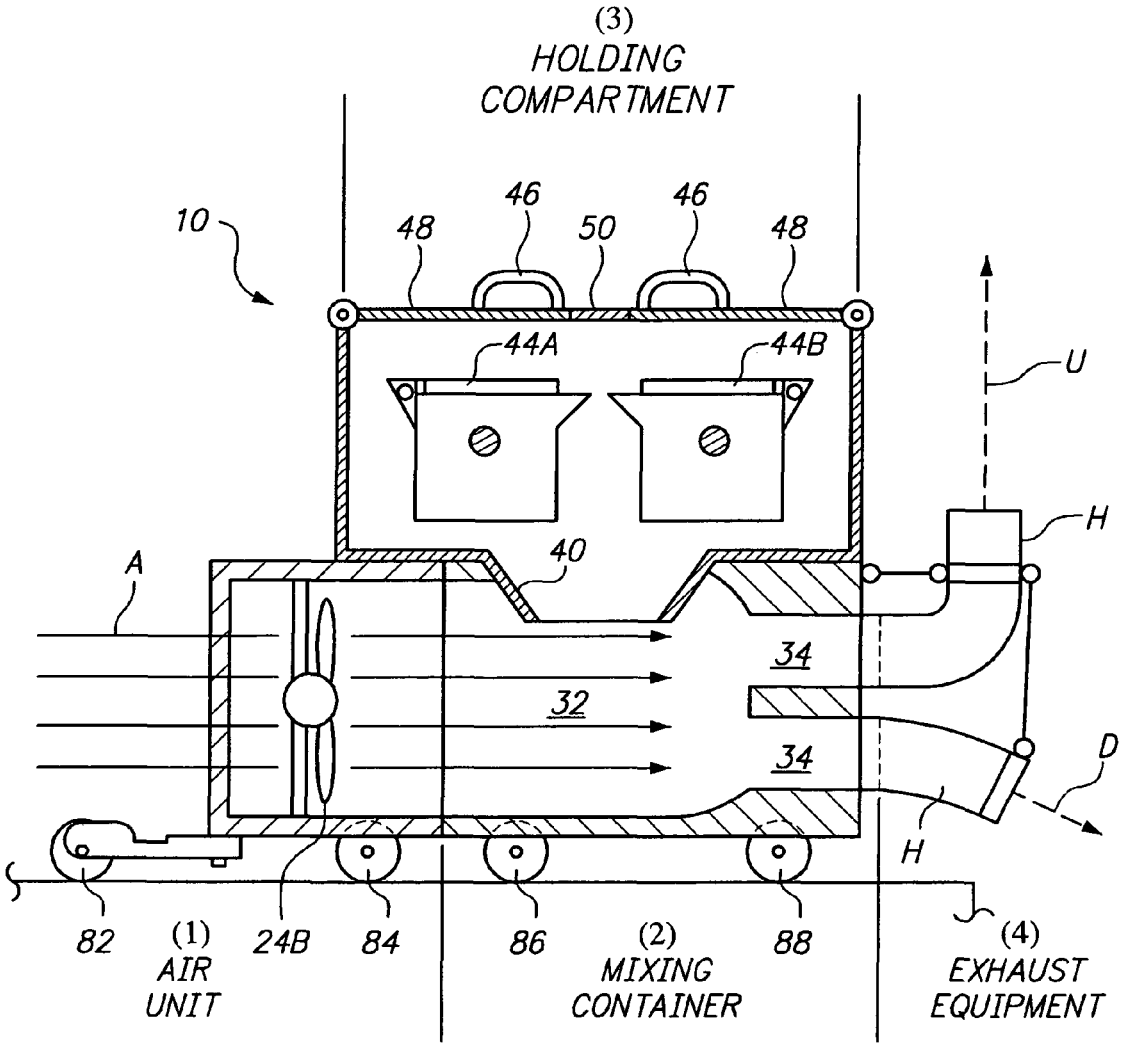
FIG. 3 is a sectional view of FIG. 2 and with the exhaust equipment added.

Refer to FIG. 3, a sectional view. The exhaust equipment (4) has been added to this view and is comprised of discharge hoses H and their mounting and support parts. The screening smoke can be discharged up U and down D. The hoses H can be of any length and configuration. The holding compartment (3) is comprised of a chute 40 with a hole protruding into the mixing chamber 32. Front and rear buckets 44A and 44B can hold any smoke making compound or element, two front and two rear top doors 48, handles 46 for lifting the doors 48 and a divider 50 between the doors 48. The mixing container (2) has a mixing chamber 32 and its outlet holes 34. The container is mounted on steerable rear wheels 88 and fixed front wheels 86. The air unit (1) produces an air-flow A and creates a pressure within the chamber 32. A fan 24B is shown.

Any number of fans, motors or buckets can be used, 1 to 10. The buckets can have any shape such as cylindrical, cubical or trapezoidal.

Figure 4:
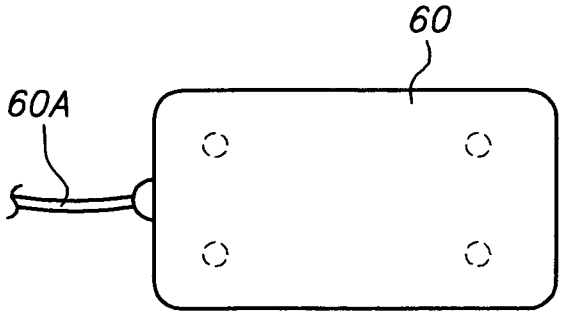
FIG. 4 is a top view of a portable electric heater.
Figure 5:
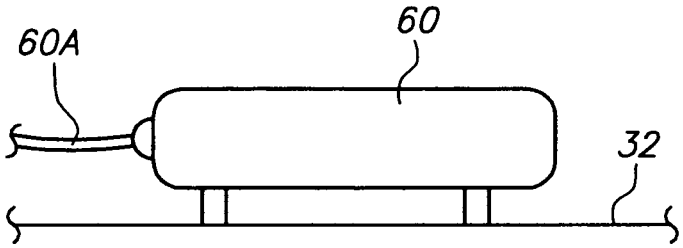
FIG. 5 is a side view of the heater.

Refer to FIGS. 4 and 5: a top view and a side view of a heavy-duty heater 60, respectively. The heavy-duty electric heater 60 is powered through a heavy-duty electric cable 60A. The heater 60 is portable and is placed on the floor of the mixing chamber 32 under the chute 40, see FIG. 3. It should provide very high temperature quickly. The cable 60A can pass through a hole adjacent the fan 24A and can be plugged into the portable control panel 92, see FIG. 8.

Figure 6:
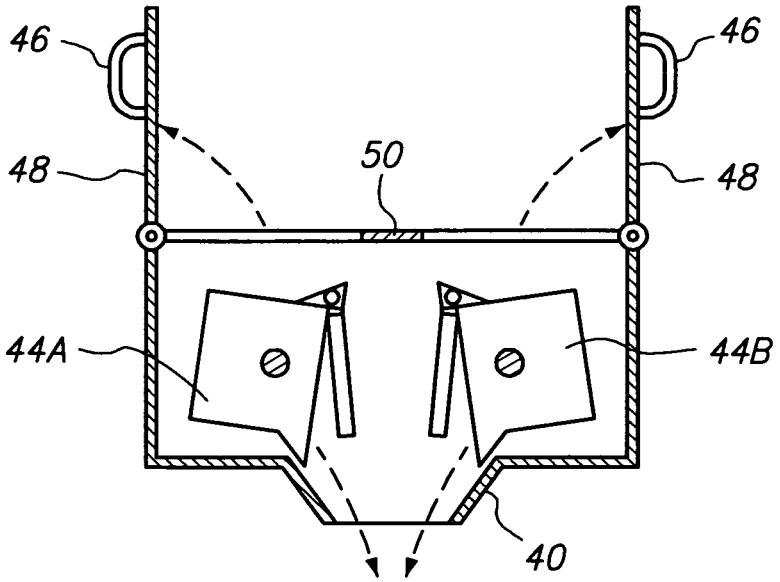
FIG. 6 is a sectional view of a holding compartment of the system.

Refer to FIG. 6: a sectional view of the holding compartment (3) removed from the system 10. The buckets 44A and 44B are in their pouring positions. They can be operated together or one at a time. The buckets 44A and 44B can be filled by way of the top doors 48, their lifting handles 46 are shown, and the divider 50 is between the doors 48. The chute 40 is below.

Figure 7:
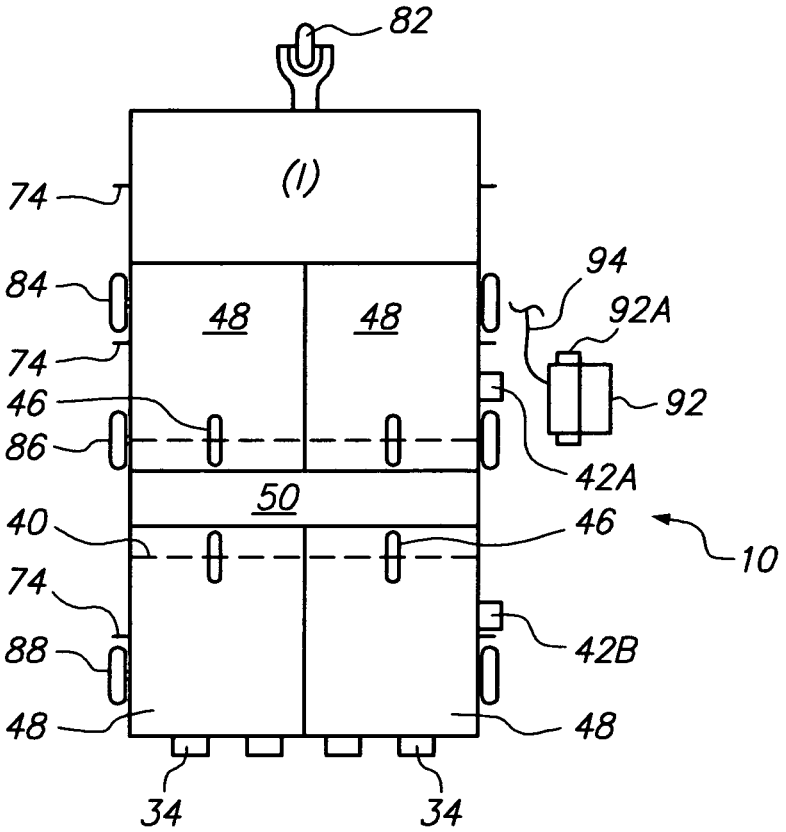
FIG. 7 is a top view of the smoke screen delivery system.

Refer to FIG. 7: a top view of the system 10. The wheels 82, 84, 86 and 88, lifting rings or tie down rings 74, servo motors 42A and 42B, outlet holes 34, top doors 48 and their lifting handles 46, the divider 50 and the chute 40 are shown. The wheels 82, 84, 86 and 88 should be solid, non-pneumatic tires. This would make the system 10 more durable and reliable. The portable control panel 92, with its handles 92A and input power cable 94, are shown as well.

Figure 8:
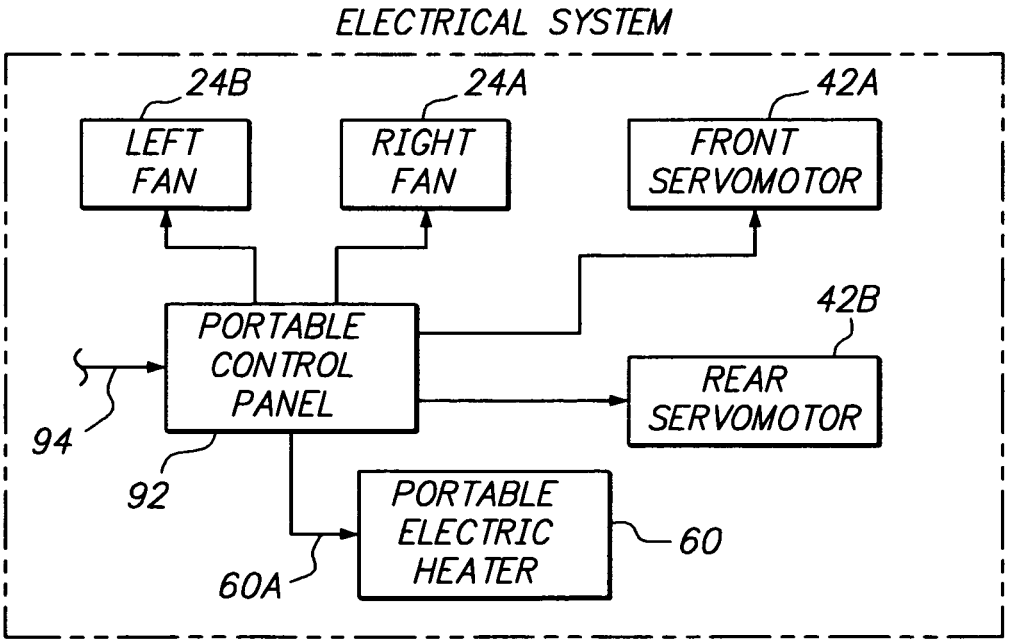
FIG. 8 is a block diagram of an electrical system of the smoke screen delivery system.

Refer to FIG. 8: a block diagram of the electrical system of this delivery system 10. The fans 24A and 24B are located in the air unit (1) at the front of the system 10, see FIG. 7. The motors 42A and 42B are located on the right side of the holding compartment (3). The electric heater 60 can be placed inside the mixing container (2) and connected to the control panel 92 by its cable 60A. The panel 92 is powered through its input electric cable 94 from a portable or fixed power supply.

The control panel 92 should be designed to control each bucket 44A or 44B, each fan 24A or 24B and the heater 60, separately and manually. For emergency—fast acting—one switch would automatically activate a fast sequence of: (1) very high temperature from the heater 60, (2) a pouring of a bucket 44A or 44B or both, and (3) both fans 24A and 24B on a moderate speed. The air flow A should be just fast enough to blow the smoke out but not too fast as that could cause the temperature of the heater 60 to be lowered too much. A servo motor 42A or 42B should be able to turn a bucket 44A or 44B respectively, into several positions between upright and maximum pouring and back.

Refer to FIGS. 1 and 2 again. The system 10, if reduced to approximately half its size, will be able to fit on many vehicles. A MEANS FOR GENERATING AN AIR FLOW through the smaller system. Only one fan 24A or 24B will be used for this smaller size. A MEANS FOR HOLDING A SMOKE SCREENING COMPOSITION before pouring it, here will be two buckets like buckets 44A and 44B shown; but each will be approximately half their ordinary width W. The system 10 can have several sizes. Review FIG. 3.

A suggested method would be to add pepper spray to the smoke making composition. It would greatly annoy an adversary without killing them. This portable smoke screen delivery system 10, I feel, would be excellent for ships that has high speeds (30 plus knots), but has light armor and/or light arms; a ship such as the Joint-High-Speed-Vessel (JHSV). A smoke screen would be a big help against a "swarm attack" of many small hostile boats as well. In addition it has the potential to be a helper in controlling unruly crowds.

Figure 9:
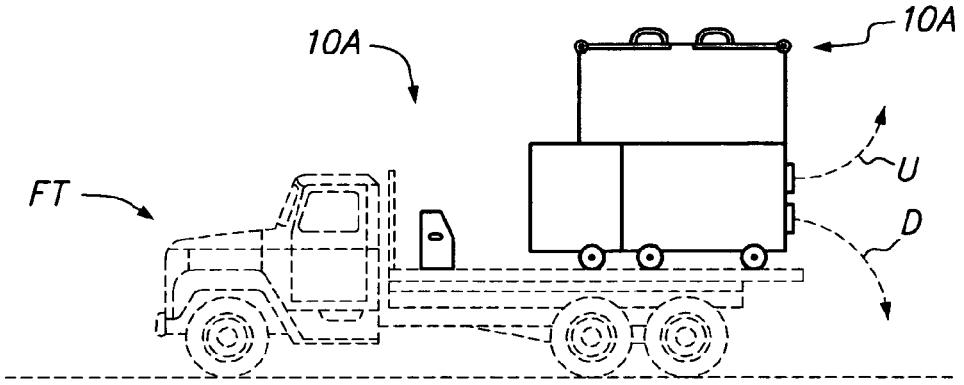
FIG. 9 is a side view of the smoke screen delivery system mounted on a flatbed truck.
Figure 10:
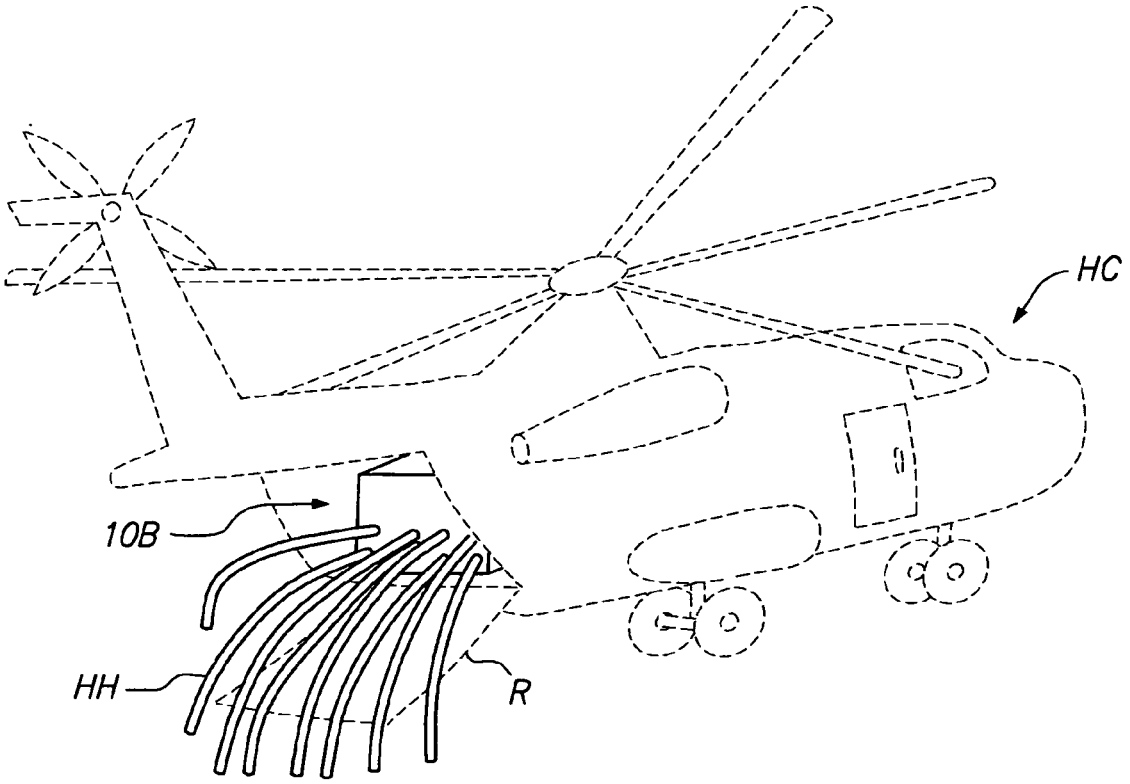
FIG. 10 is a perspective view of the system mounted in a helicopter.

In FIG. 9: a smaller version 10A of the system 10 that can eject smoke up U and down D is shown on a flatbed truck FT. The front wheel has been removed. An even smaller version 10B of the system 10 is shown in FIG. 10. The helicopter HC is a CH-53. The ramp R will be up and partially closed with the hoses HH hanging down when in flight.

Either phosphorus—heat—air (white smoke) or oil combustion (black smoke) for generating a smoke screen can be made with this delivery system 10. White smoke is preferred over black smoke; it is a much more opaque protective screen. However, either smoke screen is good when your adversaries are close by. This smoke screen delivery system 10 is a great improvement over the past ones.

However, precautions still have to be observed:

a) filling operations should be done in the open air;
b) all equipment should be thoroughly dry and cool before starting the filling operations; and
c) equipment should be thoroughly washed and dried after using to prevent corrosion.

Advantages of the present invention are the elimination of complicated operational instructions, low maintenance for the equipment, safer to operate, fast generation of a smoke screen, good effectiveness of the smoke screen and the portability of the system. No new technology is needed for this smoke screen delivery system.

I claim:

1. A portable smoke screen delivery system having major sections comprising an air unit housing, a mixing container housing, a holding compartment housing, exhaust equipment, a control panel assembly, and an electric heater; wherein:

said air unit housing is at a front of said system, an air intake and a large electric fan are adjacent to each other within said housing, said air unit housing is mounted on a front steering wheel and two rear fixed wheels;

said mixing container housing is connected to said air unit housing, said mixing container housing has a mixing chamber with a plurality of outlet holes, said mixing container housing is mounted on front wheels and rear wheels;

said holding compartment housing is connected to said mixing container housing, said holding compartment housing has a chute with a rectangular opening protruding into said mixing container housing below, said holding compartment housing has a front servo motor located on a side of said housing and connected to an inner front, rectangular-shaped bucket, and a rear servo motor located on said side of said housing and connected to an inner rear rectangular-shaped bucket, and said housing has a front door on top and a rear door on top and a divider between said doors, said doors have lifting handles;

said exhaust equipment is connected to said outlet holes of said mixing container housing and comprising discharge hoses and their mounting and support parts;

said control panel assembly of an electrical system is comprised of a portable control panel with lifting handles and an electric cable that can be connected to an electric power supply, said control panel is electrically connected to each said bucket by its said servo motor, and to said electric fan and to said electric heater;

said electric heater is portable and is connected to said system by placing it on the floor of said mixing chamber under said chute of said holding compartment housing, and connected to said control panel by its electric cable; and, whereby said system can be placed on a vehicle and said air unit housing can produce an air-flow and create a pressure within said chamber, said chamber is where a smoke making composition, heat and air meet, then the screening smoke is forced out said outlet holes.

2. A portable smoke screen delivery system as claimed in claim 1, in which said wheels have solid, non-pneumatic tires, whereby making said system more durable and reliable.

* * * * *